US009963287B2

(12) United States Patent
Vogel et al.

(10) Patent No.: US 9,963,287 B2
(45) Date of Patent: May 8, 2018

(54) INSULATED SHIPPING SYSTEM

(71) Applicant: EKOPAK, Inc., Moon Township, PA (US)

(72) Inventors: Lonny Vogel, North Huntingdon, PA (US); Christopher Edward Hall, North Huntingdon, PA (US)

(73) Assignee: Ekopak, Inc., Moon Township, PA (US)

( * ) Notice: Subject to any disclaimer, the term of this patent is extended or adjusted under 35 U.S.C. 154(b) by 132 days.

(21) Appl. No.: 15/067,485

(22) Filed: Mar. 11, 2016

(65) Prior Publication Data

US 2017/0066582 A1 Mar. 9, 2017

Related U.S. Application Data

(60) Provisional application No. 62/283,598, filed on Sep. 8, 2015.

(51) Int. Cl.

| | |
|---|---|
| ***F25D 3/08*** | (2006.01) |
| ***B65D 81/38*** | (2006.01) |
| ***F25D 3/14*** | (2006.01) |

(52) U.S. Cl.

CPC ..... *B65D 81/3813* (2013.01); *B65D 81/3834* (2013.01); *F25D 3/08* (2013.01); *F25D 3/14* (2013.01); *F25D 2303/0822* (2013.01); *F25D 2303/0831* (2013.01); *F25D 2303/0832* (2013.01); *F25D 2303/0843* (2013.01); *F25D 2303/0844* (2013.01); *F25D 2303/0845* (2013.01)

(58) Field of Classification Search

CPC ..... F25D 2303/084; F25D 2303/083; F25D 3/14; F25D 3/08; F25D 3/12; F25D 2303/0832; F25D 2303/0822

See application file for complete search history.

(56) References Cited

U.S. PATENT DOCUMENTS

| | | |
|---|---|---|
| 5,215,248 A | 6/1993 | Moser |
| 5,540,972 A | 7/1996 | Jaegers et al. |

(Continued)

FOREIGN PATENT DOCUMENTS

| | | |
|---|---|---|
| EP | 2200904 B1 | 6/2013 |

OTHER PUBLICATIONS

ProPak, Refrigerants Product webpage, http://www.propakproducts.com/refrigerants.htm, last accessed Feb. 29, 2016.

(Continued)

*Primary Examiner* — David Teitelbaum

(74) *Attorney, Agent, or Firm* — Metz Lewis Brodman Must O'Keefe LLC

(57) ABSTRACT

An insulating shipping system may include six outer walls configured into a six-sided container; an insulating layer positioned within the outer walls and formed by a plurality of insulating members; and a thermal mass layer positioned within the insulating members and made from a plurality of thermal mass members. The thermal mass members may contain a thermal energy absorbing material. The container also may have a thermal buffer layer configured to fit within the thermal mass layer. All together, these layers form a passive, thermally stabile cargo cavity for transporting temperature-sensitive cargo.

15 Claims, 8 Drawing Sheets

(56) References Cited

U.S. PATENT DOCUMENTS

| | | | | |
|---|---|---|---|---|
| 6,058,735 | A * | 5/2000 | Nathan | A61F 7/10 62/457.2 |
| 8,763,886 | B2 | 7/2014 | Hall | |
| 8,938,986 | B2 | 1/2015 | Matta et al. | |
| 9,272,811 | B1 | 3/2016 | Ranade et al. | |
| 2003/0010041 | A1* | 1/2003 | Wessling | B64G 1/50 62/60 |
| 2005/0178142 | A1* | 8/2005 | Perry | F25D 3/125 62/371 |
| 2006/0174648 | A1* | 8/2006 | Lantz | B65D 81/3816 62/371 |
| 2008/0202128 | A1* | 8/2008 | Flanagan | C09K 5/066 62/62 |
| 2014/0000306 | A1* | 1/2014 | Chapman, Jr. | F25D 3/08 62/440 |

OTHER PUBLICATIONS

ProPak, ProPak Products: Foam Coolers and Gel Refrigerants, Distributary and List Prices, dated Apr. 3, 2012.

Sonoco Thermosafe, Pallet Solutions, https://www.thermosafe.com/files/Demo/Thermosafe-Pallet-Solutions-Email-Brochure-12-20-2016.pdf. last accessed Mar. 8, 2016.

* cited by examiner 302a
202a
250

202b
302a
250

202b
302b
302c
302a
250

202b
402a
452a
302b
302c
302a
250

202b
402b
302b
402c
302a
250

202b
502b
502c
402c
502a
402a
302a
250

202a
302a
202b
502b
502c
402a
502a
402c
402d
302c
302b
402b
402a
302a
250

250
202a
302a
302c
402c
402d
402a
502c
502a
502b
202b
402b
302b
302a
250

INSULATED SHIPPING SYSTEM

CROSS-REFERENCE TO RELATED APPLICATIONS

The present application claims the benefit of U.S. Provisional Application No. 62/283,598, filed Sep. 8, 2015, entitled "Insulated Pallet Shipper Constructed From Fiber Board And Cellulose, Denim and lor [sic.] Jute Fiber", which is hereby incorporated by reference in its entirety.

BACKGROUND OF THE INVENTION

1. Technical Field

The present invention generally relates to insulated shipping systems.

2. Related Art

Systems exist for shipping temperature sensitive cargo. Some of these systems use foam, such as expanded polystyrene (EPS) or extruded polystyrene foam (XPS). While plastic foams such as these can provide insulating properties, they are usually not recyclable or biodegradable. Additionally, foam products tend to be bulky and take up a significant amount of space, making them difficult and expensive to ship.

While some recyclable or partially-recyclable systems for transporting temperature sensitive cargo exist, they are sometimes not actually recycled in practice. These systems can require the end user to separate the constituent materials with significant effort. These unrecycled systems can end up in landfills, leading to negative environmental effects.

Existing passive insulating systems can maintain the temperature of the package for only a limited time, sometimes less than a day. Systems which maintain temperature-sensitive cargo for longer periods of time may require active cooling from the transporting vehicle. Such systems for transporting temperature-sensitive cargo can be dependent on energy-intensive cooling or heating systems that are inefficient and potentially damaging to the environment. Additionally, such systems can be subject to failure, thereby potentially exposing temperature-sensitive cargo to improper temperatures.

Prior art methods can be inefficient, costly, and negatively impact the environment. Passively insulated systems may be unable to maintain temperature sensitive cargo at a predetermined temperature for extended periods of time, and actively heated and cooled systems can be expensive and subject to malfunction. Such systems can have negative environmental impacts.

SUMMARY

In one aspect, an insulated shipping system may comprise six walls, an insulating layer fitting within said six walls, and a thermal mass layer fitting within said insulating layer, wherein said thermal mass layer substantially surrounds a cargo space and said insulating layer substantially surrounds said thermal mass layer.

In another aspect, a system may include a thermal buffer layer fitting within said thermal mass layer, wherein said thermal buffer layer may substantially surround said cargo space.

In another aspect, a system may use thermal gel as the thermal energy absorbing material.

In another aspect, a system may include exterior members made from corrugated fiberboard.

In another aspect, a system may include thermally insulating material that is recyclable.

DETAILED DESCRIPTION

1. Overall Description

Figure 2:
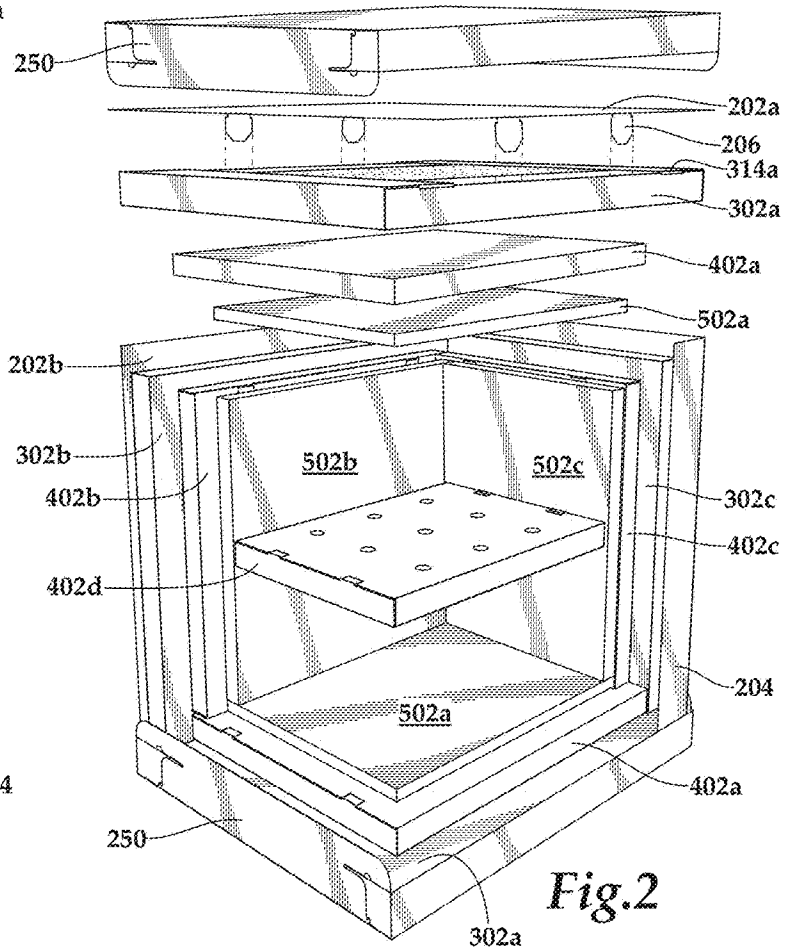
FIG. 2 illustrates a partly exploded perspective view revealing the interior of the unloaded insulated shipping system according to FIG. 1.
Figure 1:
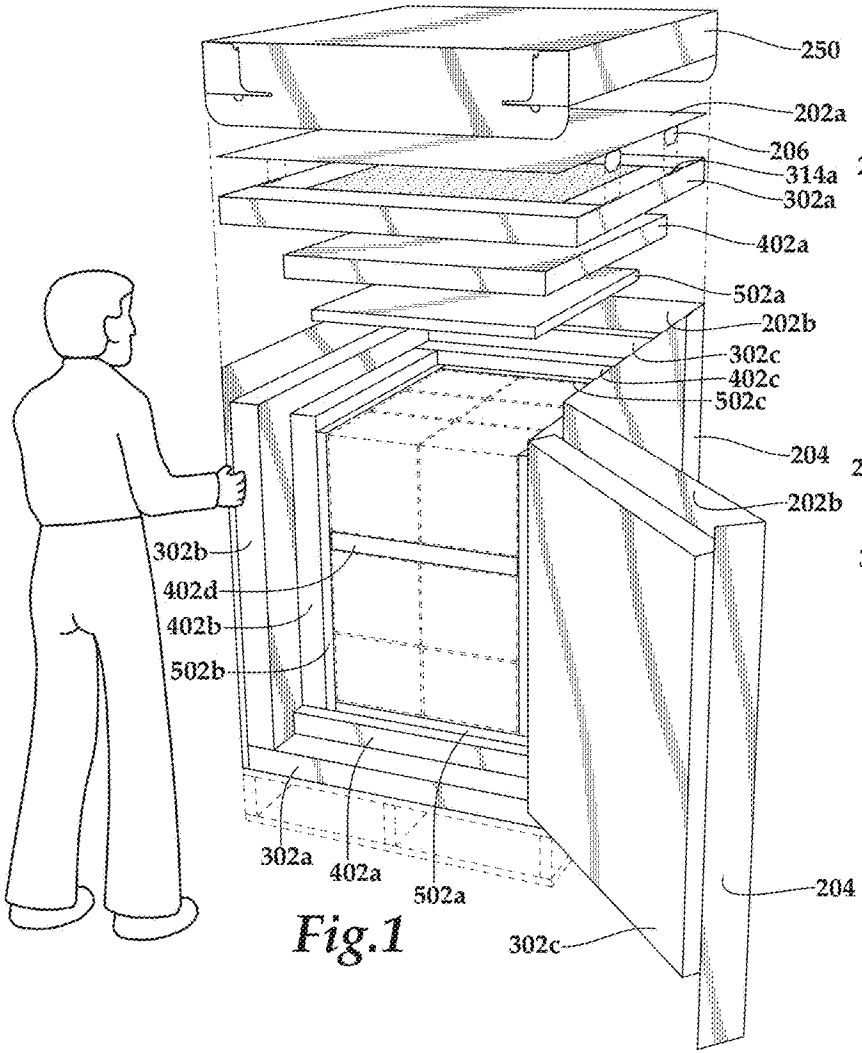
FIG. 1 illustrates a partly exploded perspective view of a loaded insulated shipping system according to an embodiment of the present invention.

As shown in FIGS. 1 and 2, insulated shipping system 10 may have an outer layer that may include two side exterior members 202*b* and two top/bottom exterior members 202*a*. A second, insulating layer may include six insulating members 302*a*, 302*b* and 302*c*. A third, thermal mass layer may include six thermal mass members 402*a*, 402*b*, and 402*c*. Optional fourth, thermal buffer layer may include six thermal buffer panels 502*a*, 502*b*, and 502*c*, which may be HEXACOMB® panels, as described in U.S. Pat. No. 5,540,972, or the like.

Cargo cavity 50 may have dimensions ranging from about 30 inches to about 40 inches long, about 20 inches to about 30 inches wide, and about 15 inches to about 35 inches high. Preferably, in a 48" tall embodiment of system 10, cargo cavity 50 may be about 32¼ inches long, about 23 11/16 inches wide, and about 33 inches tall.

As seen in FIG. 1, insulated shipping system 10 is designed to transport temperature sensitive cargo in an environmentally conscious, cost effective, and efficient manner. Shipping system 10 may be used in less-than-truckload (LTL) shipping. Using LTL shipping allows users to save costs by not requiring to ship or refrigerate an entire truckload. Additionally, system 10 does not require any type of active cooling, which also promotes environmental and cost efficiency. System 10 allows temperature-sensitive cargo to remain at a predetermined temperature range in varying environments, such as LTL shipping or other environmentally variable conditions. System 10 may be stacked up to four units high while in storage in a warehouse and up to two units high during transport.

System 10 may have outer walls, an insulating layer, and a thermal mass layer. These fit together to form a six sided insulated container as shown in FIGS. 1 and 2. System 10 also may include a thermal buffer layer. Within the multiple layers of system 10 is a cargo cavity 50, which stores and protects temperature sensitive cargo. Cargo may be stored in individual payload boxes, as shown in FIG. 1, which may be insulated themselves, depending on the nature of the cargo and expected shipping conditions. In one embodiment, about eighteen payload boxes may fit within cargo cavity 50 of system 10. System 10 may be sized such that it will fit on a predetermined standard sized pallet such as about 40 inches by about 48 inches, or other size, shown in broken lines at the bottom of FIG. 1. While three possible discrete sizes are envisioned, system 10 is adaptable to nearly any predetermined size and shape based on specific cargo needs.

The length of system 10 may range from about 40 inches to about 56 inches. Preferably the length is between about 44 inches and about 52 inches and more preferably between about 46 inches and about 50 inches. The width of system 10 may range from about 32 inches to about 48 inches. Preferably the width is between about 36 inches and about 44 inches and more preferably between about 38 inches and about 42 inches. The height of system 10 may range from about 20 inches to about 64 inches. Preferably, in one size, the height is between about 40 inches and about 56 inches and more preferably between about 46 inches and about 50 inches. One possible discrete size of system 10 ("the 24" tall embodiment") is about 48 inches long, about 40 inches wide, and about 24 inches tall. Another possible size of system 10 ("the 48" tall embodiment") is about 48 inches long, about 40 inches wide, and about 48 inches tall. Another possible size of system 10 ("the 60" tall embodiment") is about 48 inches long, about 40 inches wide, and about 60 inches tall.

The combined interaction of the various layers maintains temperature-sensitive cargo within a predetermined range of temperatures. Although more or fewer layers may be used, the layers in one possible embodiment, when described from the outermost to innermost layers, are: the outer wall, insulating layer, thermal mass layer, and thermal buffer layer. The combined thickness of all four layers combined may range from about 2 to about 12 inches and more preferably range from about 6 to about 9 inches. The combined thickness of the wall and three layers is most preferably about 7½ inches thick. System 10 is scalable to different sizes depending on the size of cargo cavity 50 required by the end user. The thickness of each layer, and thus the total thickness, may vary based on the desired shape and size of cargo cavity 50, the nature of the cargo, the temperature and humidity conditions of the external environment, and the time for which system 10 must maintain a stable temperature of the cargo.

Some embodiments may include a trapdoor (not shown) to access cargo cavity 50 without requiring disassembly of system 10. Such a trapdoor, however, may reduce the thermal performance of system 10, e.g., by allowing additional air exchange between the environment and cargo cavity 50.

Various components of system 10 are designed to substantially abut next to adjacent components. This design may improve the structural stability and rigidity of system 10 and may prevent undesired air circulation which in turn may impact heat transfer.

2. Thermal Performance of the Insulated Shipping Container

2.1 Thermal Mass Layer

As shown in FIG. 1, system 10 may contain a thermal mass layer comprised of thermal mass members 402*a*, 402*b*, and 402*c*, which absorbs heat from the external environment to stabilize the temperature inside cargo cavity 50. The thermal mass layer may contain energy absorbing materials which absorb external heat energy, and which also may absorb physical blows or shock encountered during shipping. One possible energy absorbing material that may be placed inside the thermal mass layer is thermal gel contained in one or more gel packs or substantially rigid gel bricks 480. The thermal gel has a high specific heat capacity and high latent heat of fusion. The specific heat capacity can range from about ½ BTU/($lb_m$*° F.) to about 3 BTU/($lb_m$*° F.), although ideally the specific heat capacity will be near the specific heat capacity of water, about 1 BTU/($lb_m$*° F.). Gel bricks 480 also may be frozen, so gel characterized by a high latent heat of fusion is also desirable. The range of latent heat of the gel may range from about 50 BTU/$lb_m$ to about 200 BTU/$lb_m$, with the ideal latent heat of fusion to be about that of water, about 144 BTU/$lb_m$. These characteristics allow the gel to absorb large amounts of heat energy from the environment within which system 10 is placed. By absorbing this heat energy, the temperature-sensitive cargo located in cargo cavity 50 is mostly or entirely shielded from this energy, allowing the temperature of the temperature-sensitive cargo to remain nearly constant. The thermal gel may be initially cooled or frozen to increase the amount of heat energy they can absorb and better protect the temperature sensitive cargo from external heat.

The amount and temperature of thermal gel used in each application may vary based on the needs of the temperature-sensitive cargo and the size of system 10. In one possible embodiment, system 10 may carry about eighteen payload boxes, such as the boxes disclosed in U.S. Pat. No. 8,763,886 to Hall. The '886 payload boxes may also contain additional frozen thermal gel in about two gel packs holding about 24 ounces of gel each, or about 3 pounds in each payload box and about 54 pounds in all payload boxes. Each '886 payload box may contain a quantity of about five vials each holding about 10 ml. of temperature-sensitive cargo. In total, the about eighteen payload boxes may contain about ninety vials, or about 900 ml of temperature-sensitive cargo. Thermal gel packs used in system 10 may each contain about 32 ounces of thermal gel. In total, system 10 may contain about 122 frozen thermal gel packs, or about 224 pounds total of thermal gel. In combination with the payload boxes, system 10 can hold in total about 298 lbs of frozen thermal gel. The thermal performance of this one embodiment is shown in the graph in FIG. 13 and explained below.

Thermal gel may be packaged in rigid thermal gel bricks, such as the PROPAK™ FRIGIDBRICK™ gel brick, or the like. In total, one embodiment of system 10 may contain up to about ninety-five thermal gel bricks that each contain 30 ounces of thermal gel. This leads to a total mass of thermal gel bricks of about 180 pounds, and total mass of gel in system 10, including gel in the payload boxes, may be about 254 pounds.

The amount of total thermal gel in system 10 may range from about 0 pounds to about 600 pounds and more preferably between about 150 to about 450 pounds and most preferably between about 200 and about 300 pounds. Although 24 ounce and 30 ounce gel packs or bricks are described above, any mass of gel pack or gel brick 480 may be used in different embodiments of system 10.

Throughout this application, it all be understood that references to gel amounts refer to predetermined capacity, and that not all of the capacity will need to be used in every situation, but, instead, a predetermined amount of gel may be placed in system 10 according to expected temperatures, shipping times, and other parameters known to those of ordinary skill.

The thermal mass layer may alternatively include other thermal energy absorbing materials, such as frozen water, frozen carbon dioxide (often called "dry ice"), or any other material with desirable thermal properties, such as high specific heat capacity, high latent heat of fusion, and/or high latent heat of vaporization.

2.2 Outer Layer, Thermal Insulating Layer, and Thermal Buffer Layer

Other layers of system 10 enhance thermal mass layer's ability to maintain a stable temperature of the temperature-sensitive cargo. Outer layer made from side exterior members 202*b* and top/bottom exterior members 202*a* may serve as insulation and may provide structural support for system 10. Exterior members 202*a* and 202*b* may slow the rate at which heat energy is transferred into system 10 from the external environment. Moving towards the center of system 10, the next layer, the insulating layer, is formed from insulating members 302*a*, 302*b*, and 302*c*. Also, insulating members, such as top/bottom insulating member 302*a* may contain thermally insulating material 350*a* which serve to possibly slow the rate of heat transfer deeper inside system 10.

Again moving towards the center of system 10, the next layer, the thermal mass layer, may be used to absorb at least some of the remaining heat energy that penetrates through the outer layer and insulating layer. By providing thermal mass, the thermal energy absorbing material inside thermal mass members may prevent excessive heat energy from the external environment from reaching the temperature sensitive cargo in cargo cavity 50 for over 100 hours. The thermal buffer layer, made from thermal buffer panels 502*a*, 502*b*, and 502*c*, may provide a thermal buffer between the thermal mass layer and the temperature-sensitive cargo, so the cargo may not cool too much below a desired threshold temperature.

2.3 Testing Data

Figure 13:
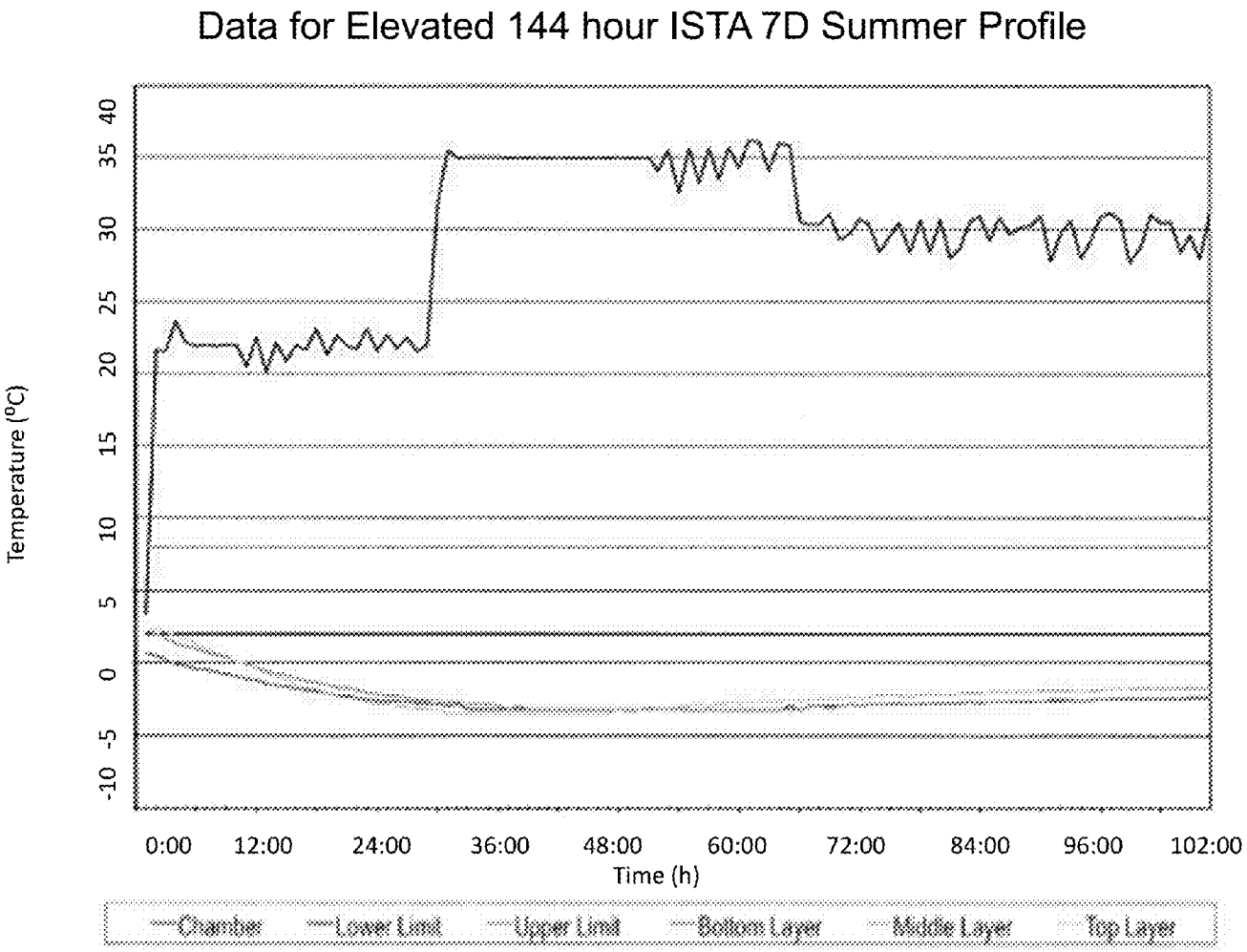
FIG. 13 shows a graph depicting a test of one embodiment of the insulated shipping system.

The thermal characteristics of a possible embodiment of system 10 is shown in FIG. 13. This graph shows the experimental data collected during a test of a prototype of system 10 using the Elevated 144 hour ISTA 7D Summer test profile. The test involved an external temperature that fluctuated as a function of time to simulate the conditions system 10 might encounter during shipping. The external temperature begins at about 24° C., and then alternates periodically between about 27° C. and about 35° C. every 24 hours. The graph also shows the temperature of the cargo cavity as a function of time. In the approximately 144 hours shown on the graph, the temperature of the cargo cavity stays within approximately a 3 degree range between about 2° C. and about 5° C., ensuring that the temperature-sensitive cargo maintains a relatively stable temperature.

Figure 14:
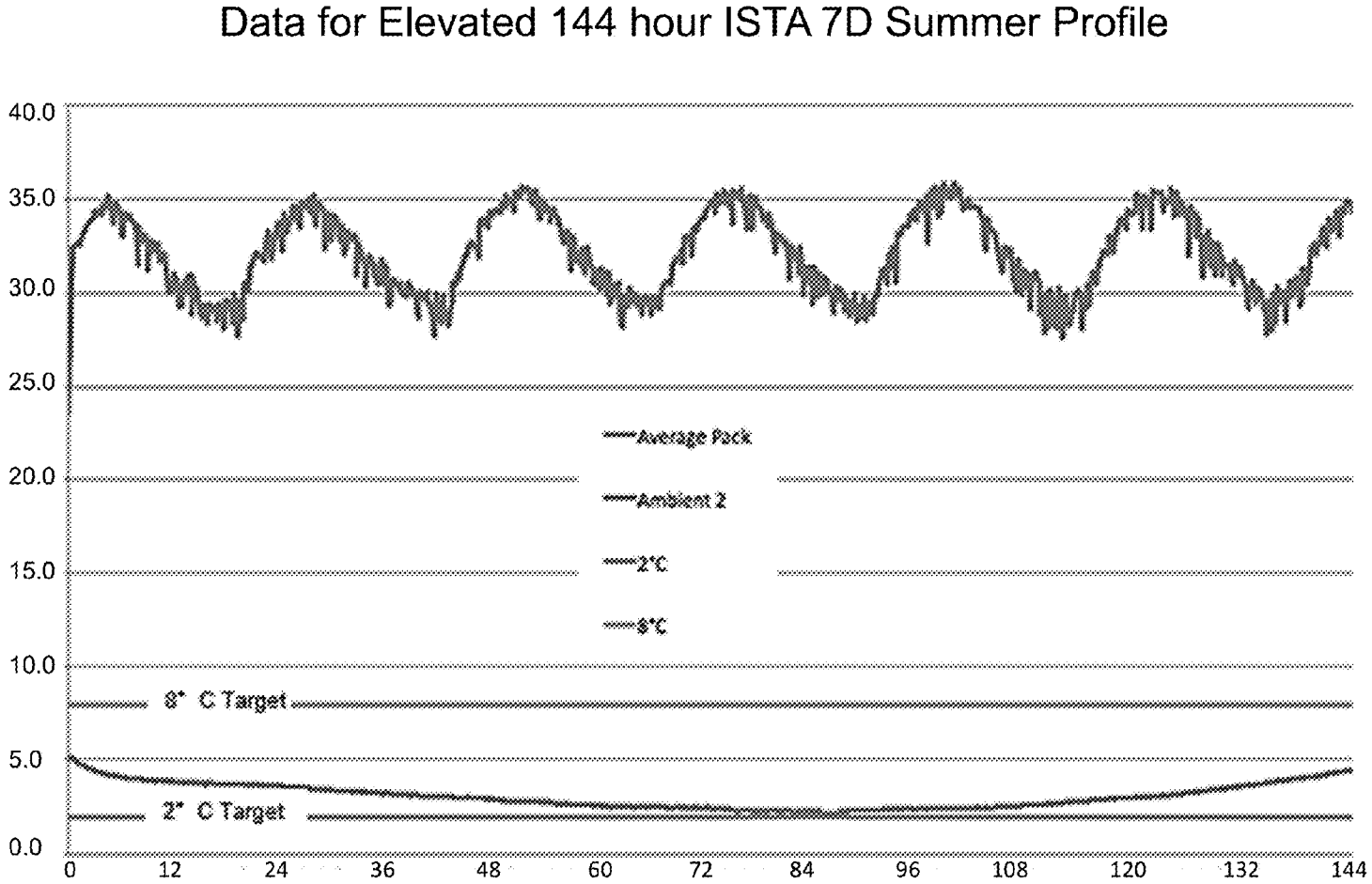
FIG. 14 shows an additional graph depicting a test of one embodiment of the insulated shipping system.

As illustrated in FIG. 14, data for a prototype of system 10 when subjected to elevated 144 hour ISTA 7D summer profile shows that even as ambient temperature is cycled to simulate predetermined variations between two different hot ambient temperatures, namely between about 28° C. and about 35° C., cargo is maintained at a temperature between 5° C. and 2° C. for about 6 days, which should be long enough to complete even long-haul shipping routes.

Alternatively, system 10 may be used without thermal energy absorbing material and used simply for its insulating properties if only a limited duration of temperature stabilization is needed.

3. Materials and Construction

When referring to illustrations of the blanks, the usual drawing conventions are applied. That is, unless otherwise indicated, broken lines indicate lines of weakness, such as fold or score lines, which facilitate rotating or folding portions of a blank; and interior solid lines indicate through-cuts. Also, when score lines and/or fold lines are referred to herein, in alternative embodiments, a score line may be replaced with a fold line or another line of weakness, and/or a fold line may be replaced with a score line or another line of weakness.

Additionally, when flanges and/or tabs are referred to herein, in alternative embodiments, a flange may be replaced with a tab or another projection, and/or a tab may be replaced with a flange or another projection. Moreover, when notches and/or slots are referred to herein, in alternative embodiments, a notch may be replaced with a slot or another cut, and/or a slot may be replaced with a notch or another cut.

Generally, a blank may be a single panel or it may be folded into two, three, four, or more panels. Similarly, when panels are shown as individual members, two or more such panels alternatively may be formed by folding a blank into the desired number of shapes and panels.

In preferred embodiments, blanks are fabricated from corrugated fiberboard material, although other materials having similar suitable performance characteristics may be employed if desired. For example, other materials may include paperboard, cardboard, non-corrugated fiberboard, polymers, metal foil, and/or biodegradable material such as biodegradable film, paper, or fiber. When made from corrugated fiberboard, blanks may be made from single or double wall corrugated fiberboard. Single wall fiberboard comprises one layer of fluted paper that is sandwiched between two smooth fiberboard paper layers. These three layers form one single wall fiberboard. Double wall fiberboard comprises three layers of smooth fiberboard paper with one layer of fluted paper sandwiched in between each layer of smooth fiberboard paper, for five total layers. The single wall fiberboard may have a thickness between about 1/16 inch and about 1/2 inch, preferably between about 1/8 inch and about 3/8 inch, more preferably about 1/4 inch. The double wall fiberboard may have a thickness between about 1/8 inch and about 1 inch, preferably between about 1/4 inch and about 7/8 inch, more preferably about 3/8 inch.

Certain blanks and/or components may be coated on one or more sides in a waterproof recyclable coating to prevent deterioration and/or weakening of fiberboard products when subjected to damp environments or from other water sources. Coating may include MICHELMAN® MICHEM® Coat 40 Plus or the like, which is applied to fiberboard products to provide water and oil resistance. MICHEM® Coat 40 Plus is a water-based coating that, when dry, resists water, oil, and grease from penetrating corrugated fiberboard.

Moreover, in some embodiments, blanks may be fabricated, erected, and/or articulated using adhering or adhesive materials, such as tape, glue, and/or a sealant. When adhesive materials are used, one or more layers may be fabricated, erected and/or articulated without adhering or adhesive materials. For example, tabs, flanges, slots, and/or notches maybe be used to fabricate, erect, and/or articulate a blank. System 10 may also be assembled using staples, nails, screws, clips, rivets, and/or other fasteners.

Preferably, system 10 is assembled using assembly tabs. These tabs reduce adhesive costs and improper gluing procedure during assembly. Additionally, they allow system 10 to be assembled and disassembled repeatedly without damage, improving its recyclability.

Preferably, the various components of system 10 fit together snugly by substantially abutting next to the adjacent component with no perceivable air gap. This promotes thermal efficiency and ensures a strong, physically stable structure.

Preferably, system 10 may be shrink wrapped either on or off of a shipping pallet. This shrink wrap provides additional stability and air-trapping properties, although it is not required for system 10 to function properly. Additionally, the bottom cap and/or bottom exterior member 202 may be attached to a pallet with staples and/or other fasteners to further secure system 10 to a shipping pallet.

4. Outer Walls

Figure 11B:
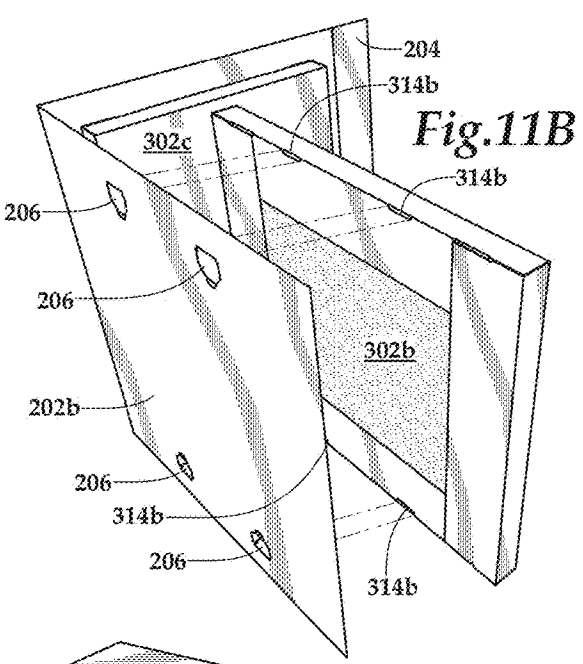
FIG. 11B illustrates the assembly of an exterior member formed from the blank of FIG. 11A and insulating members of FIG. 7B.
Figure 11A:
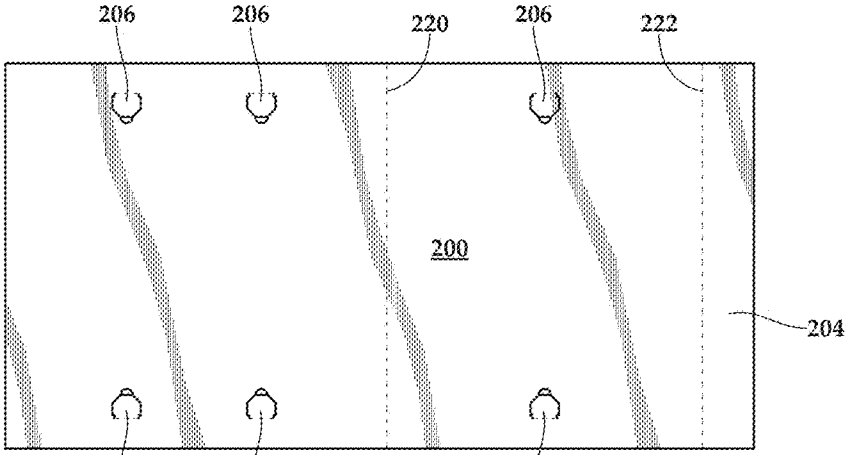
FIG. 11A illustrates blank used to create a side exterior member.
Figure 11C:
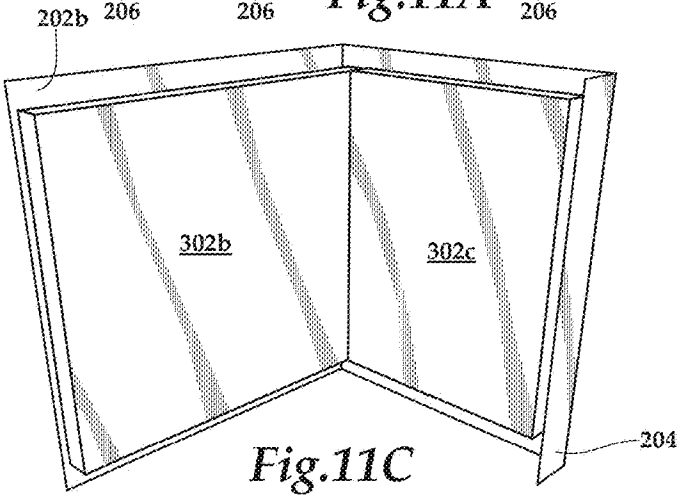
FIG. 11C illustrates a exterior member with attached insulating members.

In addition to the thermal energy absorbing material, system 10 includes other layers which may shield the temperature-sensitive cargo from temperature variations from the outside environment. As seen in FIGS. 1 and 2 the first layer of system 10, the outer wall, may comprise two side exterior members 202*a* and two top/bottom exterior members 202*b*. As shown in FIGS. 11A and 11B, each side exterior member 202*b* is folded along fold 220 to form two of the six sides of system 10. The two side exterior members 202*b* are assembled such that flap 204, formed by fold 222, of each side exterior member 202*b* folds over the opposite edge of the other side exterior member 202*b*, such that the two sides of each side exterior member 202*b* form a total of four sides of system 10. Each side exterior member 202*b*, when folded, may comprise a short panel side and long panel side. The length, height, and position of the fold on each side exterior member 202*b* ultimately determine the overall dimensions of system 10, minus this thickness of end cap 250. Both side exterior members 202*b* and top/bottom exterior members 202*a* include a plurality of tabs 206, which interface with slots 314*a*, 314*b*, and 314*c* of insulating members 302*a*, 302*b*, and 302*c*, as explained below.

4.1 Overall Dimensions Based on Exterior Members

The length of each side of system 10, as formed by the long panel of side exterior members 202*b* may range from about 40 to about 56 inches long. The width of system 10, as formed by the short panel of side exterior member 202*b*, may range from about 32 inches to about 48 inches. The height of system 10, as formed by side exterior members 202*b*, may range from about 24 inches to about 60 inches. One possible discrete size of system 10 is about 48 inches long, about 40 inches wide, and about 24 inches tall. Another possible size of system 10 is about 48 inches long, about 40 inches wide, and about 48 inches tall. Another possible size of system 10 is about 48 inches long, about 40 inches wide, and about 60 inches tall.

4.2 Exterior Member Dimensions

Flap 204 may be about 0 to about 10 inches wide, with the ideal length being about 6 inches wide. The length of top/bottom exterior members 202 may be from about 40 inches to 56 inches. Preferably, the top/bottom exterior members 202*a* are about 47 7/16 inches long. The width of top/bottom exterior members 202*a* range from about 32 inches to 48 inches. Preferably, top/bottom exterior members 202*a* are about 39 3/8 inches wide. Top/bottom exterior members 202*a* serve as the remaining two sides of system 10, such that all six sides formed by two side exterior members 202*b* and two top/bottom exterior members 202*a* form a substantially rectangular cuboid box. As seen in FIG. 11A side exterior members 202*b* are made from blank 200. In a preferred embodiment, side exterior members 202*b* and top/bottom exterior members 202*a* are made from double wall fiberboard. Double wall fiberboard is used to provide structural support and thermal insulating properties for system 10.

5. Insulating Layer

Figure 3:
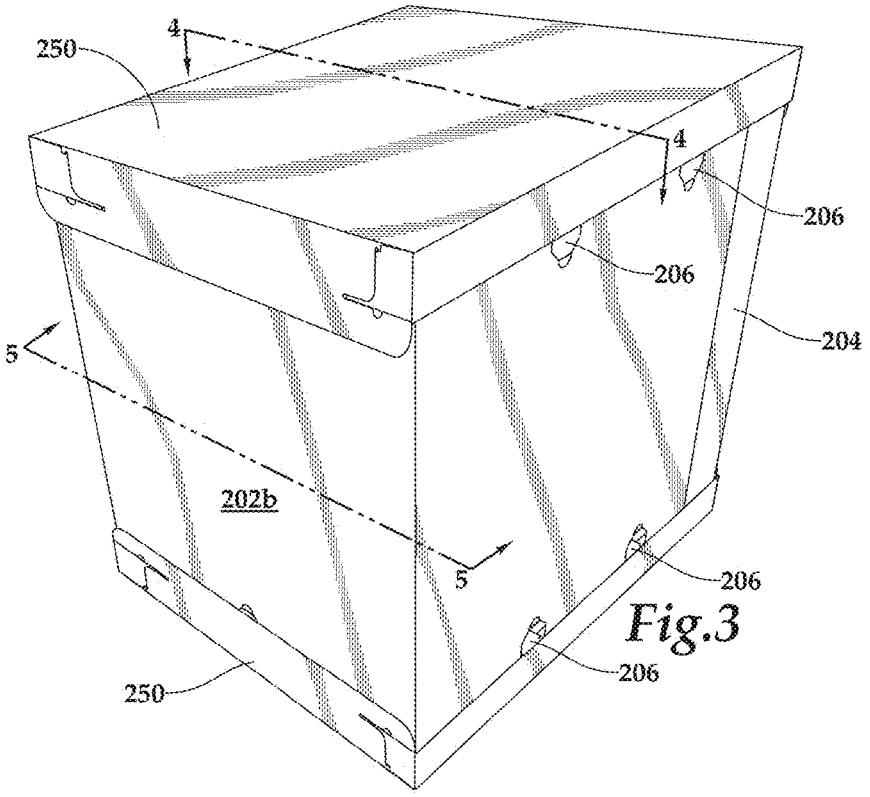
FIG. 3 illustrates a perspective view of the insulated shipping system of FIG. 1.
Figure 4:
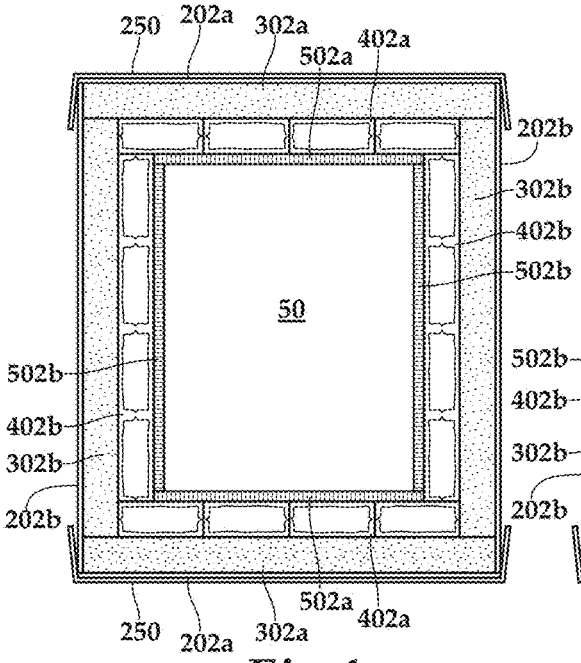
FIG. 4 illustrates a sectional view taken along line 4-4 of FIG. 3.
Figure 5:
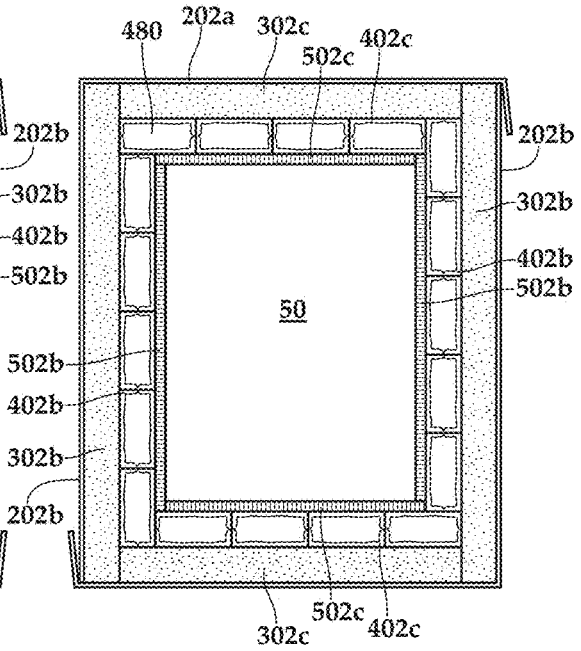
FIG. 5 illustrates a sectional view taken along line 5-5 of FIG. 3.

Moving inward to the first internal layer of system 10, after the side external members 202*b* and top/bottom insulating members 202*a*, is insulating layer comprised of six insulating members 302*a*, 302*b*, and 302*c*, as shown in FIGS. 3 and 4. Insulating members 302*a*, 302*b*, and 302*c* are removably attached to side exterior members 202*b* and top/bottom exterior members 202*a* using one or more tabs 206. Insulating members 302*a*, 302*b*, and 302*c* are located adjacent to and removably attached to the inner surface of exterior members 202*b* and 202*a*. There are three sizes of insulating members in each different sized embodiment of system 10, although each insulating member is structurally identical and is assembled in a similar way, each different size is indicated with a different lower case letter.

A long side insulating member 302*b* may removably attach to each long side panel of both side exterior members 202*b* using four tabs 206. Tabs 206 are cut out of the long panel side of each side exterior member 202*b* and interface with slots 314*b* cut into long side insulating member 302*b*.

A short side insulating member 302*c* may removably attach to each short side panel of both side exterior members 202*b* using two tabs 206. Tabs 206 are cut out of the short panel side of each side exterior member 202*b* and interface with slots 314*c* cut into the short side insulating member 302*c*.

A top/bottom insulating member 302*a* is removably attached to each top/bottom exterior members 202*a* using four tabs 206. Tabs 206 are cut out of the side of each top/bottom exterior member 202*a* and interface with slots 314*a* cut into top/bottom insulating member 302*a*.

Two of each insulating members 302*a*, 302*b*, and 302*c* form the six sides of the thermal insulating layer.

5.1 Insulating Member Dimensions

Figures 6A, 6B, 7A, 7B:
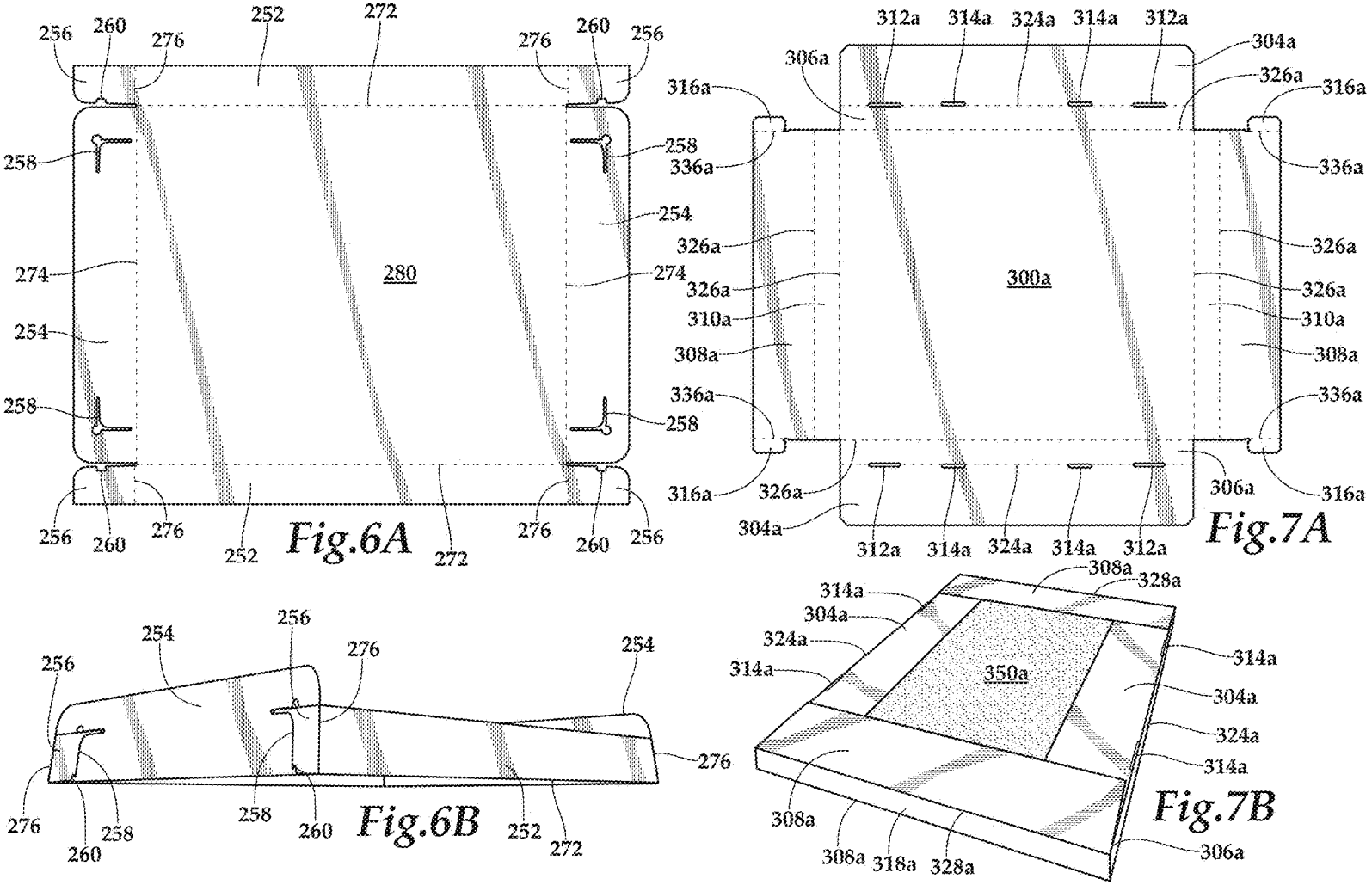
FIG. 6A illustrates a blank used to create an end cap.
FIG. 6B illustrates an end cap formed from the blank of FIG. 6A.
FIG. 7A illustrates a blank used to create an insulating member of FIG. 7B.
FIG. 7B illustrates an insulating member formed from the blank of FIG. 7A.

As shown in FIGS. 7A and 7B, each insulating member 302*a* is formed by blank 300*a* which is folded around thermally insulating material 350*a*. Flaps 304*a* are folded first around thermally insulating material 350*a* then flaps 308*a* are folded over flaps 304*a*, partially enclosing thermally insulating material 350*a* and securing it inside the insulating member 302*a*. Flaps 316*a*, formed by fold 336*a*, fit into slots 312*a* to removably secure flaps 308*a* to flaps 304*a*. When flaps 304*a* and 308*a* are folded, the sides of insulating member 302*a* are formed by sides 306*a* and 310*a*. Each side 306*a* is formed by folds 324*a* and 326*a*. Each side 308*a* is formed by folds 328*a* and 330*a*.

Of the three sizes of insulating member that are used in the 48" tall embodiment of system 10, the long side size insulating member 302*b* may be about 40 11/16 inches tall, about 46⅝ inches long, and about 3 5/16 inches thick. The short side size insulating member 302*c* may be about 40 11/16 inches tall, about 31⅝ inches long, and about 3 5/16 inches thick. The top/bottom size insulating member 302*a* may be about 46 9/16 inches long, about 38 5/16 inches wide and about 3 5/16 inches thick.

Each insulating member 302*a*, 302*b*, and 302*c* is structurally similar and contain and generally the same elements, albeit labeled with each member's corresponding letter. Only one size insulating member, insulating member 302*a*, is shown in FIGS. 7A and 7B. Insulating member 302*c* only contains two slots 314*c*, as opposed to 302*a* which contains four slots 314*a* and 302*b* which contains four slots 314*b*.

Thermally insulating material 350*a* fills at least some of the space resulting from folding blank into insulating member 302*a*. Preferably, thermally insulating material 350*a* is formed from a recyclable material with good thermal insulating properties, such as cellulose, hemp, jute, cotton, or a combination thereof, although any material with good thermal insulating properties can be used.

6. Thermal Mass Layer

Figures 8A, 8B, 9A, 9B:
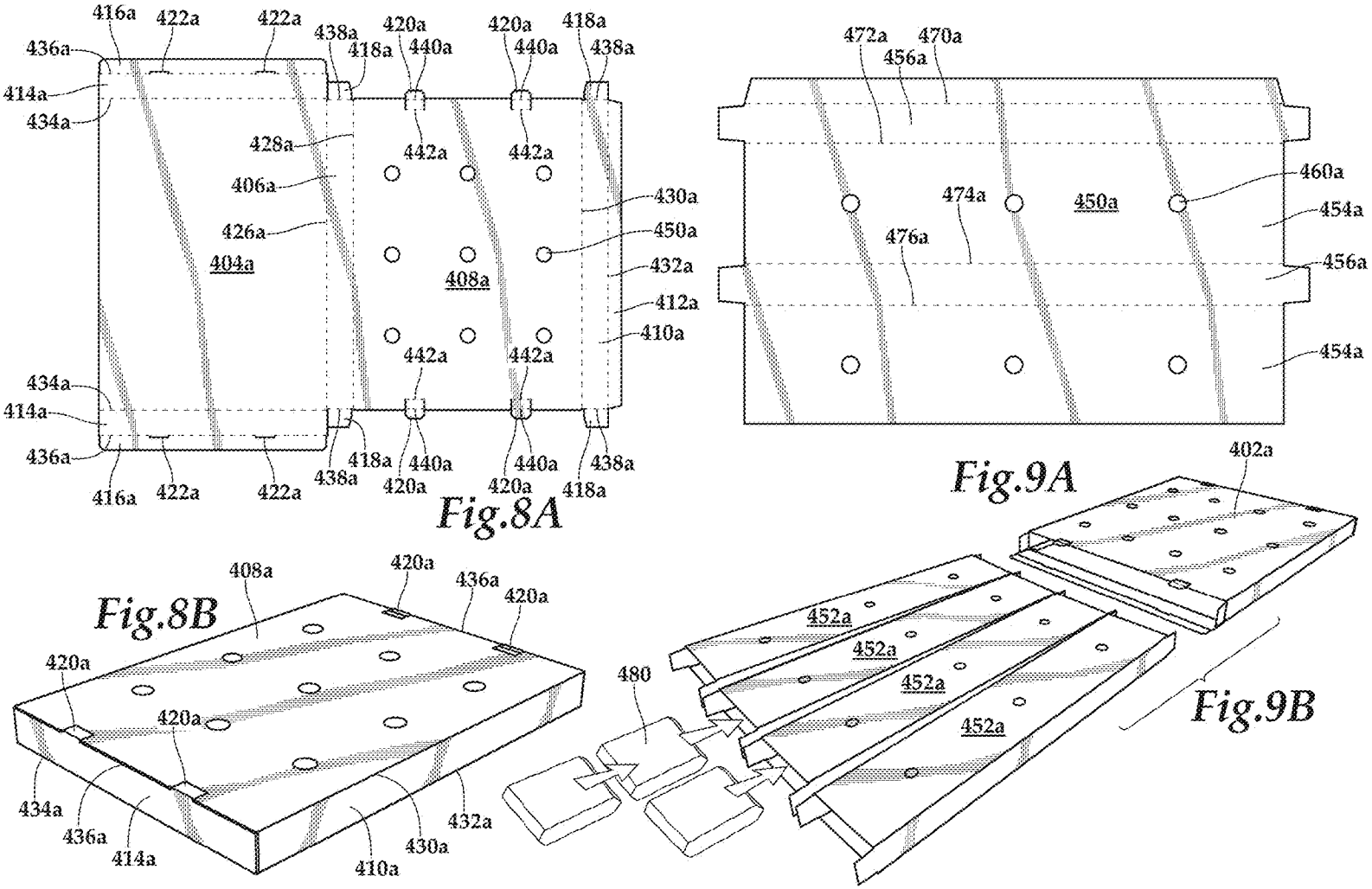
FIG. 8A illustrates a blank used to create a thermal mass member.
FIG. 8B illustrates a thermal mass member formed from the blank of FIG. 8A.
FIG. 9A illustrates a blank used to create a thermal mass sleeve.
FIG. 9B illustrates thermal mass sleeves formed from the blank of FIG. 9A being inserted into a thermal mass member of FIG. 8B.

Moving inward from the insulating layer formed by insulating panels, system 10 includes a thermal mass layer formed from six thermal mass members 402*a*, 402*b*, 402*c* and 402*d*, as shown in FIGS. 8A and 8B. Each thermal mass member is structurally similar, although only one size, 402*a* is shown in FIGS. 8A and 8B. The other thermal mass members contain generally the same elements and are assembled in a similar way. Thermal mass member 402*a* is formed from blank 400*a*. Blank 400*a* may be made from single wall fiberboard. When blank is folded along fold lines 426*a*, 428*a*, 430*a*, 432*a*, 434*a*, and 436*a*, it forms thermal mass member 402*a*. Blank tab 412*a* is glued to the opposite of the exterior face 404*a* when folded to maintain the shape of thermal mass member 402*a*. There may be up to four sizes of thermal mass member used in each embodiment of system 10. The four sizes represent the long side thermal mass members 402*b*, the short side thermal mass members 402*c*, the top/bottom thermal mass members 402*a*, and an optional internal thermal mass member 402*d*.

6.1 Thermal Mass Member Dimensions

In a 48" tall embodiment of system 10, the long side thermal mass member 402*b* may be about 37 3/16 inches wide by about 35⅛ inches tall by about 2¾ inches thick. The short side thermal mass member 402*c* may be about 28 15/16 inches wide and about 35⅛ inches tall and about 2¾ inches thick. The top/bottom thermal mass member 402*a* may be about 31⅝ inches wide and about 39⅞ inches long and about 2¾ inches thick. The internal thermal mass member 402*d* may be about 23 11/16 inches wide and about 32¼ inches long and about 2¾ inches thick.

The thermal mass layer may be formed with six thermal mass members. Two long side thermal mass members 402*b* may be used. Each top/bottom thermal mass member's 402*a* exterior face 404*a* is located adjacent to the top/bottom insulating member 302*a*. This forms two of the sides of system 10, the top and bottom. Similarly, each long side thermal mass member 402*b* is located adjacent to each long side insulating member 302*b*. Each short side thermal mass member 402*c* is located adjacent to each short side insulating member 302*c*. These form the remaining four sides of system 10. These combine with the two sides formed by the top/bottom thermal mass members 402*a* to form the six sides of insulating layer of system 10.

System 10 may include one or more internal thermal mass members 402*d*. Such member can be used if additional thermal mass is needed to keep the cargo at a specific temperature range.

6.2 Vent Holes

Thermal mass members 402*a*, 402*b*, 402*c*, and 402*d* may contain vent holes 450. One embodiment may contain twelve equally spaced vent holes on interior facing wall 408*a* of each thermal mass member. Vent holes 450 align with vent holes 460 located on thermal mass support 452*a*. The function of vent holes 450 and 460 is explained below.

7. Thermal Mass Sleeves

System 10 may include thermal mass sleeves. As shown in FIG. 9A, thermal mass sleeves 452*a* are inserted into thermal mass members 402*a*. Thermal mass sleeves 452*a* prevent the thermal energy absorbing material from moving around from side to side during shipment and transportation of system 10. When used with thermal gel, each thermal mass sleeve may hold one or more gel packs and/or gel bricks 480, shown in FIG. 9B. Each thermal mass sleeve

452*a* is made from blank 450*a* by folding along fold lines 470*a*, 472*a*, 474*a*, and 476*a*. Tab 458 is glued to blank 450*a* to maintain a sufficiently rectangular cross sectional shape for thermal mass sleeve 454*a*. The thermal mass sleeves 454*a* may include two tabs 462*a* protruding from each end of the sleeve. Tabs 462*a*, which are narrower than the width of the sleeve, allow flaps 416*a* from thermal mass member 402*a* to fit inside itself without interfering with the sleeves. Tabs 462*a* may be located on both sides to allow for either end of the thermal mass sleeve 454*a* to be inserted first into thermal mass member 402*a*.

7.1 Thermal Mass Sleeve Dimensions

Three sizes of thermal mass sleeves may be used each embodiment of system 10, although only one is shown because each size has sufficiently the same structure. One size fits in the long and short side thermal mass members 402*b* and 402*c*, the top/bottom thermal mass sleeves 452*a* fit in the top/bottom thermal mass members 402*a*, and a third size fits in the internal thermal mass member 402*d*. About four top/bottom thermal mass sleeves 452*a* fit in each top/bottom thermal insulating member 402*a*, for about eight total. About five side thermal mass sleeves fit in each long side thermal mass member 402*b*, for about ten total. About four side thermal mass sleeves fit in each short side thermal mass member 402*c*, for about eight total. Finally, about three internal thermal mass sleeves fit in the internal thermal mass member 402*d*.

In a 48" tall embodiment, the side thermal mass sleeve may be about 34½ inches long, about 7 inches wide, and about 2⁷⁄₁₆ inches thick. The top/bottom thermal mass sleeve 452*a* may be about 39¼ inches long, about 7⅝ inches wide, and about 2⁷⁄₁₆ inches thick. Internal thermal mass sleeve may be about 31⅝ inches long, about 7¾ inches wide, and about 2⁷⁄₁₆ inches thick.

7.2 Vent Holes

Thermal mass supports 452*a* may contain vent holes 460*a* both sides. There may be three vent holes 460*a* on each wall of thermal mass sleeve 452*a*. Holes 460*a* may be placed on both sides of the thermal mass sleeve 452*a*, to allow the sleeve to be inserted in either direction without impacting thermal performance. Vent holes 460*a* align with vent holes 450*a* of each thermal mass member 402*a* when each thermal mass sleeve 452*a* is inserted into thermal mass member 402*a*. The combination of vent holes 450*a* and 460*a* provide a route of increased heat transfer between thermal energy absorbing material and the surrounding layers. There may be twelve total vent holes on each thermal mass member 452*a*.

8. Thermal Buffer Layer

Figure 10:
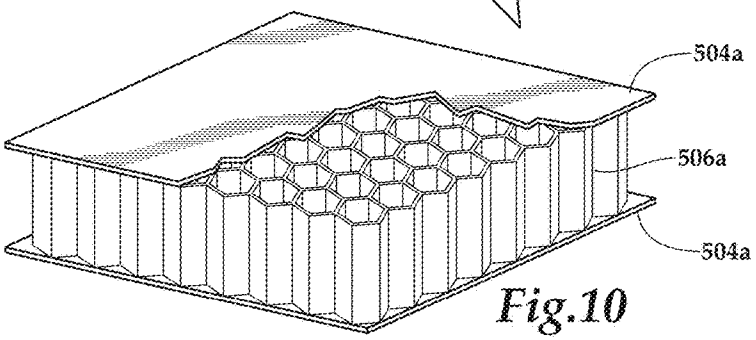
FIG. 10 illustrates a cutaway view of a thermal buffer panel as shown in FIG. 1.

As seen in FIGS. 1 and 2, system 10 may also contain a thermal buffer layer. Thermal buffer layer is made from six thermal buffer panels 502*a*, 502*b*, 502*c*. The thermal buffer panels 502*a*, 502*b*, and 502*c* slow the transfer of heat from the temperature-sensitive cargo to the thermal energy absorbing material to ensure the temperature of the temperature sensitive cargo does not fall below a predetermined temperature. These thermal buffer panels may be made from HEXACOMB® fiberboard panels, shown in FIG. 10. These HEXACOMB® panels are disclosed in U.S. Pat. No. 5,540,972 HEXACOMB® panels are made from three layers of fiberboard or similar material. The top and bottom layers 504*a* are comprised of smooth fiberboard paper and the middle layer 506*a* is made from an engineered fiberboard insert formed from a repeating series of hexagonal shapes. These hexagons trap a layer of air within thermal buffer panels 502*a*, 502*b*, and 502*c* which act as insulation to slow heat transfer from the temperature-sensitive cargo to thermal energy absorbing material. These panels also serve to cushion the temperature sensitive cargo as the hexagon shaped structure deforms and crushes under a compressive load. As disclosed in the '972 patent, HEXACOMB® panels provide protection for up to 85 G shocks.

8.1 Thermal Buffer Panel Dimensions

Returning to FIGS. 1 and 2, the dimensions of thermal buffer panels may be about 30 inches to about 40 inches long, about 25 inches to about 35 inches wide, and about ½ inches to about 1½ inches thick. The thickness of thermal buffer panels may be about 1 inch in all sizes of system 10. There may be three sizes of thermal buffer panels in each size of system 10.

In a 48" tall embodiment, long side thermal buffer panel 502*b* may be about 33 inches tall by about 33⅜ inches wide. Short side thermal buffer panel 502*c* may be about 33 inches tall by about 25 inches wide. Top/bottom thermal buffer panel 502*a* may be about 34¼ inches long by about 26 inches wide.

9. End Caps

As shown in FIGS. 6A and 6B, system 10 may include end caps 250. Each end cap 250 adds additional support to hold system 10 together and maintain its shape, particularly by removably affixing side exterior members 202*b* and top/bottom exterior members 202*a* in place. End cap 250 is formed from blank 280. Blank 280 is folded along fold lines 272 and 274, then tabs 256 are folded along fold 276 in each corner and inserted into slots 258 to removably affix each flaps 252 and 254 into place. Tabs 256 are held into slots 258 by notches 260, which anchor tabs 256 into the bottom edge of each slot 258. This forms four walls which slide over exterior members 202*b* when they are assembled into a quadrilateral shape. End cap 250 may be made from single wall corrugated fiberboard.

9.1 End Cap Dimensions

The dimensions of end cap may range from about 40 inches to about 56 inches long and from about 32 inches to about 48 inches wide. Long side flaps 252 may range from about 1 inch to 6 inches wide and short side flaps 254 may range from about 2 inches to about 10 inches wide. In all embodiments, end cap may be about 48 inches long and 40 inches wide and long side flaps may be about 4⁷⁄₁₆ inches wide and short side flaps may be about 7 inches wide.

10. Complete Assembly

Figures 12A, 12B, 12C, 12D, 12E, 12F, 12G, 12H:
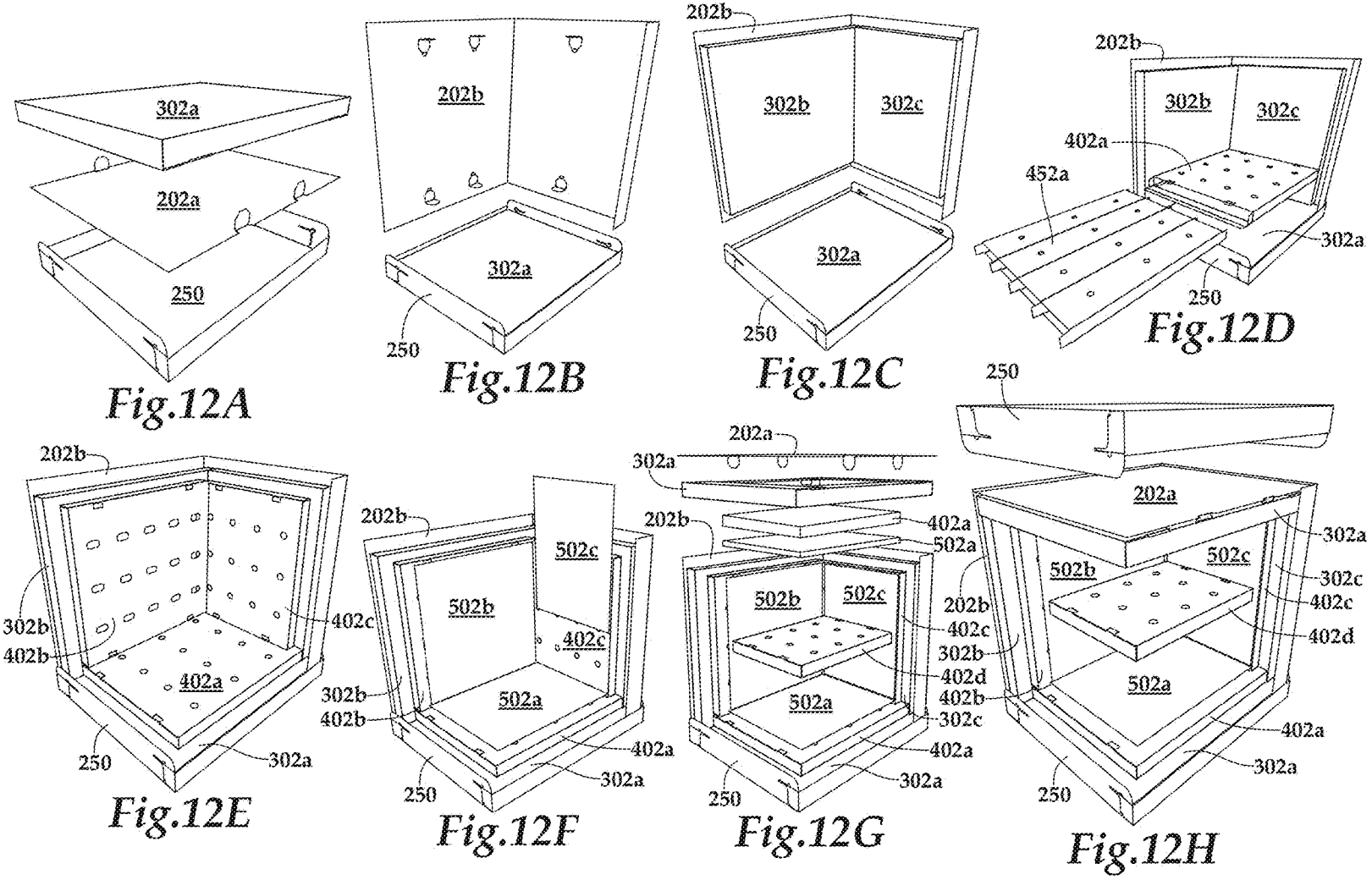
FIG. 12A shows a step in one possible sequence of assembly of the insulated shipping system of FIG. 1.
FIG. 12B shows another step in one possible sequence of assembly of the insulated shipping system of FIG. 1.
FIG. 12C shows yet another step in one possible sequence of assembly of the insulated shipping system of FIG. 1.
FIG. 12D shows still another step in one possible sequence of assembly of the insulated shipping system of FIG. 1.
FIG. 12E shows yet another step in one possible sequence of assembly of the insulated shipping system of FIG. 1.
FIG. 12F shows another step in one possible sequence of assembly of the insulated shipping system of FIG. 1.
FIG. 12G shows yet another step in one possible sequence of assembly of the insulated shipping system of FIG. 1.
FIG. 12H shows still another step in one possible sequence of assembly of the insulated shipping system of FIG. 1.

FIGS. 12A through 12 H show one possible way to assemble system 10 in one embodiment. System 10 may be assembled in a different order than the single embodiment described here. Additionally, FIGS. 12A through 12H show only part of the assembly and process to better illustrate the interior components. Other sides of system 10 may be assembled in similar steps as will be understood by one of ordinary skill in the art.

First, as shown in FIG. 12A, end cap 250 may be placed on a pallet or other surface with folded walls 252 and 254 facing upwards and away from the ground or pallet. Next, one top/bottom exterior member 202*a*, with insulating member 302*a* attached via assembly tabs 206 may be placed in end cap 250 with top/bottom exterior member 202*a* facing down. This may form outermost bottom side of system 10.

Moving on to FIGS. 12B and 12C, each side exterior member 202*b*, is folded along fold lines 220 and 222, as shown in detail in FIG. 11A, such that the long and short sides of side exterior member 202*b* form are substantially normal to one another. Next, shown in FIG. 12C, one long side insulating member 302*b* and one short side insulating member 302*c* are attached to side exterior member 202*b* using tabs 206. Tabs 206 may interface with slots 314*b* as shown in FIG. 11B. Side exterior member 202*b*, with long and short side insulating members 302*b* and 302*c* attached, is inserted into the bottom formed by end cap 250, top/bottom exterior panel 202*a*, and top/bottom insulating panel 302*a*. Although not shown in the figures, this process is repeated to form the remaining two sidewalls of system 10. When added to top/bottom exterior panel 202*a* and end cap, these elements form five sides of a rectangular or parallelpiped box.

Next is the assembly of the thermal mass layer, shown in FIGS. 12D and 12E. Each thermal mass member 402*a* is assembled by inserting four thermal mass sleeves 452*a* into each thermal mass member. A predetermined number of gel bricks 480 are inserted into each thermal mass sleeve 452*a*, shown in detail in FIG. 9B. Thermal mass members 402*b* and 402*c* are assembled in a similar way. Thermal mass member 402*a* is placed in the bottom of system 10, such that non-vented side 404*a* faces downwards adjacent to top/bottom insulating member 302*a*. Next, long side thermal mass member 402*b* and short side thermal mass member 402*c* are inserted into next two assembled side exterior members 202*b*. These are positioned such that the vented side faces of each faces inwardly and the non-vented side is placed against the interior surface of one of the insulating member 302*b* or 302*c*. The process is repeated for the other two sides not shown in the figures.

Moving on to FIG. 12F, top/bottom thermal buffer panel 502*a* is placed on top of the vented side 408*a* of thermal mass member 402*a*. Next, long side thermal buffer panel 502*b* and short side thermal buffer panel 502*c* are placed inside system 10 such that long side thermal buffer panel 502*b* is adjacent to thermal mass member 402*b* and short side thermal buffer panel 502*c* is adjacent to thermal mass member 402*a*. This process is repeated for the remaining two unshown sides of system 10. After completion of the five sides of the thermal buffer layer, cargo cavity 50 is created for transporting temperature sensitive cargo.

As seen in FIG. 12G, internal thermal buffer member 402*d* may be inserted into cargo cavity 50 after some of the cargo is loaded if needed for additional heat absorption capacity. Cargo boxes are not shown in FIG. 12G or 12H.

Turning to FIG. 12G, top/bottom thermal buffer panel 502*a* is placed on top of the edges of the side thermal buffer panels 502*b* and 502*c*, forming the sixth and final top wall to cargo cavity 50. Next, the thermal mass layer is completed by placing a top/bottom size thermal mass member 402*a* on top of top/bottom thermal buffer panel 502*a*, such that vented side 408*a* of top/bottom thermal mass member 402*a* is facing down towards top/bottom thermal buffer panel 502*a*. The insulating layer is completed by placing top/bottom exterior member 202*a*, with a top/bottom thermal insulating member 302*a* removably attached via tabs 206, such that exterior member 202*a* is facing upwards.

Finally, in FIG. 12H, the assembly of system 10 is completed by placing a second end cap 250 on top of top/bottom exterior member 202*a*, such that the folded sides 252 and 254 face downward and fit around the four side walls formed by exterior members 202*b*, again noting that half of system 10 is not shown in FIG. 12H to show the interior of system 10.

It will be understood by those of ordinary skill that the components of system 10 may be shipped from the manufacturer to the user location in mostly knocked-down and flat form, i.e., ready to assemble. Some sub-assemblies may be pre-assembled, for example, those that are glued, such as insulation members and thermal mass sleeves. It may be desirable and attainable to provide the user with a system 10 that can be assembled largely or entirely without staples, fasteners, glue, tape, or the like. In this way, assembly is relatively easy and almost foolproof. Instructions such as the sequence of FIGS. 12A-12H and accompanying description. Few if any tools may be required of the user, and generally no special tools may be needed. Similarly, the recipient of a fully erected and loaded system 10 may find it easy to open and unload the system and to disassemble it into its respective recyclable and reusable components. (Gel packs may be reused: other components may be recycled.)

10.1 Alternative Loading Method

System 10 may also be configured to allow the short side of exterior member 202*b* to open, which allows loading from the side instead of the top of system 10. Such a configuration may be achieved by removing tabs 256 from one side of both the top and bottom end caps 250 and swinging the short side of external member 202*b* open along fold line 220. Next the short side thermal insulting member 402*c* may be removed, along with the short side thermal buffer panel 502*c*, allowing access to cargo cavity 50.

It will be understood by those of ordinary skill that thermally biased, e.g., refrigerated or frozen, gel packs or bricks may be loaded into sleeves, and sleeves into thermal mass members, on site by the user. Similarly, it will be understood that system 10 may be loaded or unloaded as needed, e.g., over a period of time or in a series of locations.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

11. Additional Detailed Description

As seen in FIGS. 1 and 2, insulating shipping system 10 that includes six walls made from exterior members 202*a* and 202*b*, an insulating layer made from insulating members 302*a*, 302*b*, and 302*c* fitting within those six walls, and a thermal mass layer made from thermal mass members 402*a*, 402*b*, and 402*c* fitting within that insulating layer, where the thermal mass layer substantially surrounds cargo cavity 50 and said insulating layer substantially surrounds said thermal mass layer.

System 10 may also include a thermal buffer layer made from thermal buffer panels 502*a*, 502*b*, and 502*c* fitting within said thermal mass layer where the thermal buffer layer substantially surrounds said cargo cavity 50.

Exterior members 202*a* and 202*b* may be made from corrugated fiberboard.

Exterior members 202*a* and 202*b* may be made from double wall corrugated fiberboard.

System 10 may also include two end caps 250 forming a base and a top.

The outer walls of system 10 are made of four sidewalls made from two side exterior members 202*b* and a top and bottom wall both made from one exterior member 202*a;*

The insulating layer may include two long side insulating members 302*b*, two short side insulating members 302*c*, and two top/bottom insulating members 302*a*.

The thermal mass layer may include two long side thermal mass members 402*b*, two short side thermal mass members 402*c*, and two top/bottom thermal mass members 402*a*.

The thermal mass members 402*a*, 402*b*, and 402*c* may contain a plurality of thermal gel bricks 480 and may include vent holes 450.

The thermal buffer may include two long side thermal buffer panel 502*b*, two short side thermal buffer panel 502*c*, and two top/bottom thermal buffer panel 502*a*.

Each top/bottom exterior members 202*a* may interlock with each top/bottom thermal insulating member using four tabs 206. Each side exterior member 202*b* may interlock with one long side thermal insulating panel 302*b* and one short side thermal insulting panel 302*c* using six tabs 206.

System 10 may be about 48 inches long, about 48 inches high, and about 40 inches wide.

Each one of thermal insulating members 302*a*, 302*b*, and 302*c* may have a thickness of between about 2 and about 4 inches;

Each one of thermal mass members 402*a*, 402*b*, 402*c*, and 402*d* may have a thickness of between about 1½ and about 3½ inches; and Each thermal buffer panels may have a thickness of between about ⅛ and about 1½ inches.

The overall thickness of each side of system 10, including one exterior member 202*a* or 202*b*; one thermal insulting member 302*a*, 302*b*, or 302*c*; one of thermal mass member 402*a*, 402*b*, or 402*c*; and one of thermal buffer panel 502*a*, 502*b*, or 502*c*; may be between about 5 and about 8 inches.

Thermal buffer panels 502*a*, 502*b*, and 502*c* may have a honeycomb construction.

The thermal energy absorbing material may be thermally biased gel.

The thermal energy absorbing material may be frozen carbon dioxide.

Thermal mass members include thermal mass sleeves which may be configured to fit inside said thermal mass members.

Thermal mass members 402*a*, 402*b*, 402*c*, and 402*d* may include vents 450 leading toward said cargo cavity 50.

Thermal insulating members 302*a*, 302*b*, and 302*c* may be made from corrugated fiberboard.

Thermal mass members 402*a*, 402*b*, 402*c*, and 402*d* may be made from corrugated fiberboard.

Thermal buffer panels 502*a*, 502*b*, and 502*c* may be made from corrugated fiberboard.

Thermally insulating material 350*a* may be recyclable.

The mass capacity of thermally biased gel such as in gel bricks 480 in sleeves in system 10 may be between about 150 and about 200 pounds.

We claim:

1. An insulating shipping system, comprising:

two end caps forming a base and a top;

six walls comprising four sidewalls, a top wall, and a bottom wall;

an insulating layer fitting within said six walls, said insulating layer comprising four side insulating members, a top insulating member, and a bottom insulating member;

a thermal mass layer fitting within said insulating layer, said thermal mass layer comprising four side thermal mass members, a top thermal mass member, and a bottom thermal mass member;

wherein said top, bottom, and side thermal mass members are adapted to hold thermal energy absorbing material and are provided with vent holes on an internal side of each one of said top, bottom, and side thermal mass members; and a thermal buffer layer fitting within said thermal mass layer, said thermal buffer layer comprising four side buffer panels, a top buffer panel, and a bottom buffer panel;

wherein said thermal buffer layer substantially surrounds a cargo cavity, said thermal mass layer substantially surrounds said thermal buffer layer, and said insulating layer substantially surrounds said thermal mass layer;

wherein said bottom wall interlocks with said bottom insulating member, said top wall interlocks with said top insulating member, and each one of said sidewalls interlocks with a corresponding one of said side insulating members; and wherein said bottom thermal mass member lays above said bottom insulating member with said vent holes facing inward, each one of said side thermal mass layers is placed upright and adjacent a corresponding one of said side insulating members with said vent holes facing inward, said bottom buffer panel lays above said bottom thermal mass member and each one of said side buffer panels fits adjacent to a corresponding one of said side thermal mass members, said top buffer panel being positioned above said cargo cavity and said top thermal mass member being positioned above said top buffer panel with said vent holes facing inward, said top wall with said top insulating panel attached fitting above said top thermal mass member, and said end cap fitting above and around said top wall and said sidewalls.

2. The insulating shipping system according to claim 1 wherein said walls are made from corrugated fiberboard.

3. The insulating shipping system according to claim 1 wherein said walls are made from double wall corrugated fiberboard.

4. The insulating shipping system according to claim 1 wherein said system is about 48 inches long, about 48 inches high, and about 40 inches wide;

each one of said thermal insulating members has a thickness of between about 2 and about 4 inches;

each one of said thermal mass members has a thickness of between about 1½% and about 3½ inches; and each of said buffer panels has a thickness of between about ⅛ and about 1½ inches.

5. The insulating shipping system according to claim 1 wherein one of said walls, a corresponding one of said top, bottom, and side insulating members, and a corresponding one of said top, bottom, and side thermal mass members have a combined thickness of between about 5 and about 8 inches.

6. The insulating shipping system according to claim 1 wherein each of said top, bottom, and side buffer panels has a honeycomb construction.

7. The insulating shipping system according to claim 1 wherein said thermal energy absorbing material is thermally biased gel.

8. The insulating shipping system according to claim 7, wherein a mass capacity of thermally biased gel in sleeves is in the range of 150 to 200 pounds.

9. The insulating shipping system according to claim 1 wherein said thermal energy absorbing material is frozen carbon dioxide.

10. The insulating shipping system according to claim 1 wherein:

each of said top, bottom, and side thermal mass members include internal thermal mass supports which are configured to fit inside corresponding ones of said top, bottom, and side thermal mass members;

said thermal mass supports reduce the relative movement of the said thermal energy absorbing material.

11. The insulating shipping system according to claim 1 wherein said thermal mass layer includes vents on said internal side leading into said cargo cavity.

12. The insulating shipping system according to claim 1 wherein said top, bottom, and side insulating members are made from corrugated fiberboard.

13. The insulating shipping system according to claim 1 wherein said top, bottom, and side thermal mass members are made from corrugated fiberboard.

14. The insulating shipping system according to claim 1 wherein said top, bottom, and side thermal buffer panels are made from corrugated fiberboard.

15. The insulating shipping system according to claim 1 wherein said top, bottom, and side insulating members include insulating material that is recyclable.

* * * * *